US006294265B1

(12) United States Patent
Ioelovich et al.

(10) Patent No.: US 6,294,265 B1
(45) Date of Patent: Sep. 25, 2001

(54) HYDROPHOBIC BIODEGRADABLE CELLULOSE CONTAINING COMPOSITE MATERIALS

(75) Inventors: Michael Ioelovich, Bat-Yam; Oleg Figovsky, Haifa, both of (IL)

(73) Assignee: Rademate Ltd., Nesher (IL)

( * ) Notice: Subject to any disclaimer, the term of this patent is extended or adjusted under 35 U.S.C. 154(b) by 0 days.

(21) Appl. No.: 09/401,197

(22) Filed: Sep. 23, 1999

(51) Int. Cl.[7] ..... B32B 23/08; C08L 29/04; D21H 17/36; D21H 17/37; D21H 17/38

(52) U.S. Cl. ..... 428/507; 428/485; 428/486; 428/510; 428/514; 106/203.2; 106/203.3; 162/135; 162/168.7; 162/172; 162/231; 524/524

(58) Field of Search ..... 106/203.2, 203.3; 162/135, 168.7, 172, 231; 428/507, 485, 486, 510, 514; 524/503, 524; 442/154, 155, 159

(56) References Cited

U.S. PATENT DOCUMENTS 4,187,142 * 2/1980 Pickelman et al. ..... 162/146
5,989,724 * 11/1999 Wittosch et al. ..... 428/511
6,132,822 * 10/2000 Overcash et al. ..... 428/34.2

* cited by examiner

*Primary Examiner*—David W. Wu
*Assistant Examiner*—Kelechi Egwim
(74) *Attorney, Agent, or Firm*—Blank Rome Comisky & McCauley LLP

(57) ABSTRACT

Composite cellulose containing materials which are waterproof and biodegradable are produced which consist essentially of cellulose and hydrophobic polymer-based composition in the amount about 4 to 40 wt %. The polymer-based composition comprises first polymer, which is partially saponified polyvinyl acetate, second polymer, which functions as plasticizer for improving elasticity of the first polymer and cross-linking agent, which is capable to cross-link the first polymer. The polymer-based composition may additionally contain environmentally friendly hydrophobizators, fillers and pigments.

20 Claims, No Drawings

HYDROPHOBIC BIODEGRADABLE CELLULOSE CONTAINING COMPOSITE MATERIALS

FIELD OF THE INVENTION

The present invention is related mostly to the field of manufacturing of cellulose materials namely paper, paperboard, cardboard and other cellulose containing materials. More specifically the present invention refers to waterproof and biodegradable cellulose containing composite materials.

BACKGROUND OF THE INVENTION

Natural polymers e.g. starch and its derivatives, dextrin, alginates, lecithin, casein, gelatin, soybean protein and some synthetic polymers like methyl-, carboxymethyl- or hydroxyethyl-cellulose, polyvinyl alcohol, polyacrylic acid and other hydrophilic polymers or their combinations are widely used for manufacturing of cellulose composite materials, like sized and coated paper, paper-and cardboard etc. Description of manufacturing processes along with resulting products can be found in many references for example in Encyclopedia of Industrial Chemistry. Vol.A18, 1996; in U.S. Pat. Nos. 4,133,784, 5,057,570, 5,328,567 and 5,527,852. It is well known to add hydrophilic polymers to the pulp for sizing of cellulose material. The hydrophilic polymers are also used for coating the surface of cellulose materials. Usually the coating is applied on cellulose material in a form of aqueous gel and then dried. The coated cellulose materials are in fact composites and since the material of coating is biodegradable such composites are environmentally friendly. The disadvantage of such composites is associated with the fact that they are hydrophilic and not stable against humidity, water and aqueous solutions.

U.S. Pat. Nos. 4,863,655 and 5,362,776 disclose preparation of cellulose composite materials for packaging which comprise cellulose fibers and hydrophilic binders like starch, gelatin, polyvinyl alcohol, polyethylene glycol and polyethylene oxide. Despite these materials are biodegradable they are not sufficient waterproof.

Cellulose composite materials having various hydrophobic protected coating layers have been proposed. Such protected coatings contain various compounds, e.g. polyolefin and additives (U.S. Pat. No. 5,296,307), copolymers of olefins and unsaturated carboxylic acids and pigments (U.S. Pat. No. 3,970,629); a mixture of polyvinyl chloride and ethylene-acrylic copolymer (U.S. Pat. No. 4,365,029). In U.S. Pat. Nos. 3,985,937, 4,117,199, 4,395,499, 4,503,185, 4,599,378, 4,657,821, 5,763,100 and 5,744,547 are disclosed hydrophobic coatings for protection of cellulose substrates containing aqueous latex of synthetic rubbers, polyvinyl esters, polyacrylates, various copolymers, paraffin wax, organically acids, fillers and some other additives. The coatings were applied on cellulose substrate in a form of aqueous latex and dried then. These cellulose composite materials are waterproof, however their biodegradability is not sufficient and therefore they cause pollution of the environment.

There are known also papers treated by silicon organic substances (U.S. Pat. Nos. 3,856,558 and 4,349,610). These coated papers are sufficiently waterproof however they are bio-stable and thus polluted the environment.

U.S. Pat. No. 5,053,268 discloses composite paper containing sheets of synthetic film and paper bonded with urethane adhesive. This composite was water-resistance, but not biodegradable. Some hydrophobic biodegradable polymers and co-polymers like poly-β-hydroxyalkanoates (PHA) have been used as coating layers for manufacturing composite cellulose materials (Witt U. et al., Biologisch abbaubare Polymere, Braunschweig, 1997, p.151). These polymers or co-polymers contain ester links that can be destroyed by microorganisms of the environment. PHA in melted state was applied on the cellulose substrate at temperatures above 150–160 degrees C. Upon cooling a solid water-resistant PHA layer was formed on the cellulose substrate. Nowadays such polymers and co-polymers of PHA type are produced in small amounts from rather rare raw materials. The manufacturing technology is complicate and thus the cost of such materials is high (US $ 20–40 per kg). It should be pointed out that the biodegradation process of PHA is relatively slow. For example PHA destruction in soil takes more than 8 months. Furthermore the application of PHA on cellulose substrate at the above mentioned temperatures is associated with its thermal destruction.

Coating of cellulose substrate by aqueous dispersions (latexes) of PHA is known in the art (Lauzier C. A., et al.—Tappi Journal, 1993, vol.76, No 5, p.71–77; U.S. Pat. No. 5,350,627). The cellulose substrate was impregnated by PHA latex, then dried under room temperature and pressed for few minutes at 100–140 degrees C. that is below the melting point of PHA. Due to the low pressing temperature and short period of time it is possible to avoid thermal destruction of cellulose. However since the particles of PHA do not melt it is not possible to obtain a monolithic and homogeneous coating. As a result the paper composite has loose, porous coating layers and thus decreased waterproofing and reduced water resistance. Another disadvantage of the above mentioned method is associated with the necessity to treat the paper by dilute aqueous dispersion of PHA (5–20% or 50–200 g/l). This causes considerable swelling, warping and possible mechanical damage of initial hydrophilic and porous cellulose substrate during the further steps of the production process. Moreover, PHA is very expensive raw material.

SUMMARY OF THE INVENTION

Thus despite availability of various processes for manufacturing of cellulose composite materials there is strongly felt a requirement in a new process for production of waterproof and biodegradable cellulose composite materials.

The main object of the present invention is to satisfy the above requirements and to provide a new and improved waterproof, biodegradable and inexpensive cellulose composite materials. Still further object of the invention is to provide a new and improved method of manufacturing of these materials according to which the harm influence of high temperatures and water to the cellulose materials is prevented.

The above and other objects and advantages of the present invention can be achieved in accordance with the following combination of its essential features, referring to different embodiments thereof.

The waterproof biodegradable cellulose composite material consisting of a cellulose component and a hydrophobic polymer-based component.

The composition of the polymer-based component comprises:

a) 45–94 weight % of a first polymer, which is preferably polyvinyl acetate, said polymer is capable of cross-linking and contains about 2 to 8 wt % of free hydroxyl groups. The first polymer will be referred to further as PVA;

b) 4–28 weight % of a second polymer, which is preferably non cross-linked and capable to impart to the first polymer improved elastic properties. The second polymer will be referred to further as polymeric plasticizer or PL;

c) 2–20 weight % of a cross-linking agent, having at least two functional hydroxyl, carboxyl, amine and/or aldehyde groups, said agent will be referred to further as CLA.

In accordance with the further embodiments the composition of the polymer-based component may contain hydrophobizing agents selected from either natural biodegradable compounds or synthetic environmentally friendly silicon organic substances.

In accordance with one of the embodiments of the invention the first polymer (PVA) should contain 2–8 weight % of free hydroxyl groups and the second polymer (PL) should be chosen from the group, comprising polyalkylacrylates and co-polymers of alkylacrylate-vinyl or alkylacrylate-alkylmethacrylate with about 5–20 weight % of vinyl or methacrylic links.

In accordance with the further embodiment of the invention the weight ratio of PL to PVA should be 0.05–0.43.

In yet another embodiment the amount of hydrophobizing agent in the polymer-based component should be 0.5 to 10 weight %.

According to still further embodiment various fillers, pigments or other functional additives may be optionally introduced in the polymer-based component and amount of these additives should be 0.5–5 weight %.

The first polymer (PVA) containing above mentioned content of free hydroxyl groups is prepared by weak saponification of the polyvinyl acetate latex at increased pH-value. In accordance with the invention the aqueous PVA dispersions having concentration 300 to 600 g/l and viscosity 100 to 3000 mPa·sec can be advantageously used for treatment of cellulose containing materials, like various types of paper, paperboard, cardboard, fabric, fibers, etc. The prepared cellulose composite materials comprising the above polymer-based component in the amount of 4–40 weight percent are waterproof and are defined by improved biodegradability.

DETAILED DESCRIPTION OF THE PREFERRED EMBODIMENTS

The invention employs cellulose containing materials and preferably aqueous dispersions of PVA (latex) having concentration 300–600 g/l and containing additives of certain polymers, copolymers, cross-linking agents, hydrophobizing agents, fillers and pigments. The products prepared from these ingredients are composites consisting essentially of a combination of the cellulose containing component and the hydrophobic polymer-based component.

These products can be in various forms.

These forms include:

a) cellulose containing substrate coated by the polymer-based component, b) bulk material consisting of mixture of cellulose component and polymer-based component, c) substrate consisting of mixture of cellulose containing component and polymer-based component, said substrate is coated by polymer-based component.

It has been empirically revealed that the best results in terms of biodegradability and waterproofing are achieved when the amount of polymer-based component in the product is about 4 to 40 weight %.

In accordance with the invention the polymer-based component comprises polymeric composition with the following main constituents:

(a) first polymer, which is preferably cross-linked polyvinyl acetate (PVA) containing about 2 to 8 wt % of free hydroxyl groups;

(b) second polymer, which is preferably not cross-linked and is selected from the group consisting of polyalkylacrylates and copolymers of alkylacrylate-vinyl or alkylacrylate-alkylmethacrylate, containing about 5 to 20 wt % of vinyl or methacrylic links;

(c) cross-linking agent, having as minimum two functional hydroxyl, carboxyl, amine and/or aldehyde groups; the equivalent ratio of these groups in CLA to the stoichiometric content of free hydroxyl groups in PVA should be 0.4 to 1.2

It has been unexpectedly found that when the weight ratio of the second polymer to first polymer in the polymer-based component is about 0.05 to 0.43, then the second polymer improves elasticity of the first polymer and thus the mechanical properties of the final composite product;

It is advantageous if the polymer-based component contains also environmentally friendly hydrophobizing agents, as well fillers, pigments or other functional additives.

The first polymer containing said content of free hydroxyl groups is prepared by weak saponification of PVA latex at pH=10–12. This partly saponified PVA is biodegradable in wet soil under the influence of various fungi and bacteria. Unfortunately this PVA as taken alone is hard and insufficiently hydrophobic and therefore unsuitable for manufacturing of elastic and waterproof cellulose composite materials. In order to improve the elasticity of PVA and the whole composite product, the second polymer which functions as plasticizer (PL) can be advantageously added. It has been empirically established that in accordance with the invention it is expedient to employ environmentally friendly polymeric plasticizers which are compatible with the PVA, for example polyalkylacrylate or its copolymers. The preferable PL/PVA ratio is about 0.05 to 0.43.

In order to make the PVA less hydrophilic, a cross-linking agents and hydrophobizing agents can be introduced in the polymer-based component. Cross-linking of partly saponified PVA occurs during drying of the cellulose containing material at temperatures 90–130 degrees C. after it is mixed with or is coated by said polymeric composition. The environmentally friendly substances containing at least two functional hydroxyl, carboxyl, amine and/or aldehyde groups can be advantageously employed as suitable cross-linking agents. The non-limiting list of such agents includes glyoxal, succinic acid, dimethylol-urea, urea- or melamine resin, etc.

The cross-linking agent should be added to the polymer-based component in such amount, that the equivalent ratio of these functional groups is about 0.4 to 1.2 to the stoichiometric content of free OH-groups in PVA.

The content of free hydroxyl groups in the PVA should be about 2 to 8 wt % for completing the cross-linking process.

Hydrophobizing agents are modifying additives, which are introduced in the polymer-based component to render the final product waterproof. As such agents one can use natural biodegradable substances like fatty acids and natural waxes having melting point ($T_m$) of 30 to 90 degrees C. The preferred content of natural hydrophobizing agent in the polymer-based component lies between 0.5 and 3 wt %. In practice the hydrophobizing agent is added to aqueous dispersion of the first and second polymer together with the cross-linking agent Then the mixture is milled to obtain dispersion with particles size up to 1–2 microns.

During the drying step, which is carried out at temperatures $T>T_m$ the natural hydrophobizing agent melts and penetrates within micro pores of the polymeric component. Upon cooling the product becomes monolithic waterproof structure.

Active synthetic hydrophobizing agents can also be used to improve waterproofing. These agents interacts with the hydrophilic cellulose substrate at drying temperature and render it more hydrophobic. The environmentally friendly silicon organic substances can be employed as suitable active hydrophobizing agents e.g.vinyl-, allyl-, alkyl- or phenyl-alkoxysilanes; polyalkylhydrosiloxanes; and polyalkylhydroxysiloxanes. The preferred content of the hydrophobizing agent in the polymer-based component lies between 0.5 and 5 wt %. In an additional embodiment of the invention some environmentally friendly fillers, like chalk, talc, kaolin, etc. as well natural pigments may be introduced in the polymer-based component. The preferred amount of these additives lies between 0.5 and 5 wt %.

In practice the preferred concentration of the aqueous PVA dispersion lies between 300 and 600 g/l and its viscosity between 100 and 3000 mPa·sec.

In accordance with the invention the polymer-based component and thus the final product consists of solely environmentally friendly and biodegradable constituents. These constituents include dedicated polymers, copolymers, cross-linking agents, hydrophobizing agents, fillers and pigments. By virtue of this provision waterproof and biodegradable cellulose composite material can be produced.

Below are listed commercially available products, which can be used in practice as suitable constituents.

As suitable latex one can use aqueous dispersion of polyvinyl acetate Servinyl 817, 929, 1051, 4364 and 4365, manufactured by Serafon Co (Israel); Resyn 1025, 1090, 1411, 1601, X-208 and Dur-O-Set SB-321, manufactured by National Starch and Chemicals Co; Wallpol 40-100 and 40-103, manufactured by Reichhold Chemicals Inc.; Daratak 17-200, 17-230, 17-300, 56L and 65L, manufactured by W. R. Grace Co.; Vinamul 8440 and 8481, manufactured by Vinamul GmbH. (Germany).

As suitable polyvinyl acetate latex, which may be used for partial saponification one can use the following commercially available products: Dartak 56L, Resyn 1025, 1090 and 1411, Wallpol 40-100, Servinyl 920, 1051 and 4364.

As suitable aqueous latex of polyalkylacrylates and their co-polymers one can use Seracryl 995, 4367, 6815, 6825, 6975, 7164 and 40205, available from Serafon Co. (Israel); Nacrylic X-4280, X-link 252813 and X-link 252833, available from National Starch and Chemical Co.; Rhoplex Ac-33, AC-34, AC-388 and B-15, available from Rohm and Haas Co.; Synthemul 40–412 and 40–423, available from Reichhold Chemicals Co.; Texicryl 13-103 and 13-104, available from Scott Bader Co. (UK); Versaflex 2 and 3, Everflex E, MA and ME available from W. R Grace Co; Plextol BV 411 and DV 544 available from Polymer Latex GmbH (Germany).

Preferable commercially available products suitable for improving elasticity of the first latex include Rheoplex AC-33, AC-34 and AC-338; Seracryl 6815, 6825, 6975, 7164 and 40205; Everflex E, T, MA, MB, SP-1084 and SP-1087; Plextol BV411 and DV544.

As suitable cross-linking agent one can employ the following commercially available products: Resimene U-970, AQ-1616 and AQ-7550, available from Solutia Inc.; Cymel 303 and 373, available from American Cyanamid Co.; Kymene 435, available from Hercules Co.; EU40, Aurarez 136, Protorez 6036 and BLF-C, available from Sybron Chemicals Inc.; A-12084, available from Alfa Aesar Co; Glyoxal P, Urescoll SU and SMV available from BASF AG (Germany).

Preferable cross-linking agents are Resimene AQ-1616, Cymel 373, Kymene 435, Aurarez 136, Protorez BLF-C, EU40, A-1 2084, Glyoxal P and Urescoll SMV. Natural hydrophobizator Mastercote FP-9002, available from Warner and Jenkinson Co. (UK); Camauba wax LT-314, Bees wax 3044K, 3050 A, 3060 A and 3070I, available from Tromm GmbH (Germany); Safacid 16/18 AM, available from Hydro Oleochemicals A.S. (Norway). Preferable commercially available natural hydrophobizing agents include Carnauba wax LT-314, Beeswax 3044 K and Safacid 16/18 AM.

Synthetic hydrophobizing agents include silicon organic compounds: Chem-Trete BSM-40, Aqua-Trete, Dynasylan BH, PTEO, IBTEO and OCTEO available from Sivento GmbH (Germany); Petrarch PS-120, M-8980, M-9050, P-0320 and V-4910, available from United Chemical Technol. Inc.

In practice preferable commercially available synthetic hydrophobizators are Dynasylan BH, PTEO, IBTEO and OCTEO; Petrarch PS-120, M-9050 and P-0320.

List of suitable fillers and pigments includes Snobrite, Snofil, Snofil P and HW, available from Evans Clay Co.; HWF-Kaolin, available from Dry Branch Kaolin Co.; Nytal and Ceramitalc, available from Gouverneur Talc Co.; RubiChem Dry-Dip C, available from Struktol Co.; PR-101, PR-102 and PY-42, available from Kremer GmbH (Germany); J-3100, 3103, 3106, 3110 and 3118, available from Mineral Pigment Co. Preferable commercially available fillers and pigments are Snofil, Nytal, RubiChem Dry-Dip C, PR-101 and J-3100. One can mention also additional commercially available chemicals, which can be used in the present invention: soda available from Arm & Hammer Co.; citric acid available from Dream Mart Co.

The aqueous dispersions of the polymer-based component may be introduced in the cellulose containing material or applied thereon by any conventional methods and devices including bar -, roll-, blade- or air knife coaters and other conventional equipment.

For testing of properties the following procedures were implemented:

Deuterium exchange rate was measured for testing of content of free hydroxyl groups in partly saponified polyvinyl acetate;

Water absorption of coated cellulose materials was determined by Cobb-test in accordance with ASTM D3285;

The biodegradability was assessed by weight loss of cellulose composite materials at composting in wet soil. The weight loss was measured at composting conditions described in ASTM D2020-B and ASTM D5988.

In the following non-limiting examples the invention is described in more details without limiting the scope thereof.

EXAMPLE 1

Sodium bicarbonate (Arm & Hammer Co.) was added at agitation to dilute aqueous dispersion (latex) of polyvinyl acetate known as Servinyl 920 (Serafon Co.). The concentration of the latex was 470 g/l; Sodium bicarbonate was added to obtain pH value of about 10.1. The latex was heated to about 35 degrees C. and kept 20 min. Then, citric acid (Dream Mart Co) was added to the latex at agitation to achieve pH value of about 4. Deuterium exchange analysis was indicated that the obtained first polymer (PVA) contained about 2.1 wt % of free OH-groups. The latex of second polymer, namely polybutyl acrylate, known as Plextol DV 544 (Polymer Latex GmbH), diluted up concentration 470 g/l, was introduced to the PVA latex as plasticizer (PL) up to weight ratio PL/PVA about 0.08.

Then, cross-linking agent (CLA), namely 40% solution of dimethylol urea resin known as EU-40 (Sybron Chemicals Inc.) was added to the mixture. The equivalent ratio of functional groups in the CLA to the stoichiometric content of free OH-groups in PVA was 0.41. The content of ingredients in the composition that related to solid polymer-based component was as follows: PL about 7.3 wt % and CLA about 2.7 wt %.

The ingredients were mixed in blender at 200–300 rpm for 10–15 min.

Then the dispersion, having concentration of solid about 500 g/l, was applied on the Kraft-paper with density 70 g/m$^2$ by means of a bar coater. The coated paper was dried at 90 degrees C. in an air dryer for 3–5 min. The obtained composite was in the form of coated cellulose substrate. The amount of polymer-based component in the product was 18 weight %.

EXAMPLE 2

Sodium bicarbonate (Arm & Hammer Co.) was added at agitation to dilute aqueous dispersion (latex) of polyvinyl acetate known as Dartak 56L (W. R. Grace Co.). The concentration of the latex was 370 g/l. Sodium bicarbonate was added to obtain pH value about 11.2. The latex was heated to about 35 degrees C. and kept during 25 min. Then, citric acid (Dream Mart Co) was added to the latex at agitation to achieve pH value about 4. Deuterium exchange analysis indicated that the obtained first polymer (PVA) contained about 5.6 wt % of free OH-groups. The latex of second polymer, namely polyethyl acrylate, known as Plextol BV 411 (Polymer Latex GmbH), diluted up to concentration 400 g/l, was added to said PVA latex as plasticizer (PL) up to weight ratio PL/PVA about 0.1.

Then, 42% solution of cross-linking agent (CLA), namely glyoxal known as Aurarez 136 (Sybron Chemicals Inc.) was added to the latex mixture. The equivalent ratio of the CLA-functional groups to the stoichiometric content of free OH-groups in the PVA was 0.8.

An active synthetic hydrophobizing agent namely polymethylhydrosiloxane known as Petrarch PS-120 (United Chemical Technologies Inc.) was added to the mixture. Then a filler, namely kaolin, known as Snofil (Evans Clay Co.) and a pigment, namely iron oxide, known as J-3100 (Mineral Pigments Co.) were also added to the mixture.

The content of ingredients in the composition of the solid polymer-based component was as follows: PL about 8.1 wt %, CLA about 6.1 wt %, hydrophobizator about 0.5 wt %, filler about 4 wt % and pigment about 1 wt %.

The ingredients were mixed in blender at 200–300 rpm for 10–15 min.

The resulting composition having concentration of solid about 450 g/l was applied by means of a bar coater on Kraft-paper having density 70 g/m$^2$. The coated paper was dried at 130 degrees C. in air dryer during 3–5 min. The ready product was cellulose composite containing 14 wt % of polymer-based component in the form of a coating.

EXAMPLE 3

Sodium bicarbonate (Arm & Hammer Co.) was added at agitation to dilute aqueous dispersion (latex) of polyvinyl acetate known as Resyn 1025 (National Starch & Chemicals Co.). The concentration of the latex was 230 g/l; and sodium bicarbonate was added to obtain pH value about 12. The latex was heated to about 35 degrees C. and kept for 30 min. Then, citric acid (Dream Mart Co) was added to the latex at agitation to achieve pH value about 4. Deuterium exchange analysis was indicated that the obtained first polymer (PVA) contained about 7.9 wt % of free OH-groups. Latex of the second polymer, namely polypropyl acrylate, known as Seracryl 6825 (Serafon Co.), diluted up concentration 300 g/l, was introduced to the PVA latex as plasticizer (PL) up to weight ratio PL/PVA about 0.42. Then, 48% solution of cross-linking agent (CLA), namely melamine resin, known as Resimene AQ-1616 (Solutia Inc.) was added to the mixture. The equivalent ratio of the CLA-functional groups to the stoichiometric content of free OH-groups in PVA was 0.5. Moreover, hydrophobizing agent, namely octyltriethoxysilane known as Dynasylan OCTEO (Sivento GmbH) was added to the mixture. Besides of the above constituents to the mixture were added natural wax, known as Carnauba wax LT-314 (Tromm GmbH), and iron oxide pigment known as J-3103 (Mineral Pigments Co).

The content of ingredients in the composition of the solid polymer-based component was as follows: PL about 25.3 wt %, CLA about 12 wt %, hydrophobizator about 2 wt % and pigment about 0.5 wt %.

The mixture was milled in a ball mill at 300–400 rpm during 10–15 min to particle size of dispersion 1–2 microns.

Then the dispersion having concentration of solid about 350 g/l was applied on the Kraft-paper with density 70 g/m$^2$ by means of a bar coater. The coated paper was dried at 120 degrees C. in an air dryer during 3–5 min. The obtained composite was in the form of coated cellulose substrate. The amount of polymer-based component in the product was 10 wt %.

EXAMPLE 4

Sodium bicarbonate (Arm & Hammer Co.) was added at agitation to aqueous dispersion (latex) of polyvinyl acetate known as Servinyl 4364 (Serafon Co.). The concentration of the latex was 500 g/l and sodium bicarbonate was added to obtain pH value about 11. The latex was heated to about 30 degrees C. and kept during 20 min. Then, citric acid (Dream Mart Co) was added to the latex at agitation up to pH value about 4. Deuterium exchange analysis indicated that the obtained first polymer (PVA) was contained about 4.3 wt % of free OH-groups.

Latex of the second polymer, namely copolymer of ethylacrylate and butylmethacrylate (18 wt %), known as Seracryl 4367 (Serafon Co.), having concentration 500 g/l, was introduced as plasticizer (PL) into said PVA latex up to weight ratio PL/PVA about 0.2. Then, 60% solution of cross-linking agent (CLA), namely urea resin, known as Kymene 435 (Hercules Co.) was added to the latex mixture. The equivalent ratio of CLA-functional groups to the stoichiometric content of free OH-groups in PVA was 0.67.

Moreover, additional hydrophobizing agents, namely isobutyltriethoxysilane, known as Dynasylan IBTEO (Sivento GmbH) in the amount of 3 wt % and natural wax, known as Beeswax 3044K (Tromm GmbH) in the amount of2 wt %, as well 1 wt % of chalk filler, known as RubiChem Dry-Dip C (Struktol Co.), were added to the mixture.

The content of ingredients in the composition of solid polymer-based component was as follows: PL about 14.7 wt %, CLA about 7.3 wt %, hydrophobizators about 5 wt % and filler about 1 wt %.

The mixture was milled in a ball mill at 300–400 rpm during 10–15 min to obtain particles sizes of dispersion 1–2 microns.

Then the dispersion having concentration of solid 600 g/l was applied on the Kraft-paper with density 55 g/m$^2$ by means of a bar coater. The coated paper was dried at 125 degrees C. in an air dryer during 3–5 min. The obtained composite was in the form of coated cellulose substrate. The amount of polymer-based component in the product was 31 wt %.

EXAMPLE 5

Sodium bicarbonate (Arm & Hammer Co.) was added at agitation to aqueous dispersion (latex) of polyvinyl acetate, known as Servinyl 920 (Serafon Co.). The concentration of the latex was 500 g/l; Sodium bicarbonate was added to obtain pH value about 10. The latex was heated to about 30° C. and kept during 10 min. Then, citric acid (Dream Mart Co) was added to the latex at agitation up to pH value about 4. Deuterium exchange analysis indicated that the obtained first polymer (PVA) contained about 1.6 wt % of free OH-groups.

Latex of the second polymer, namely polybutyl acrylate, known as Seracryl 995 (Serafon Co.) having concentration 500 g/l was introduced as plasticizer (PL) into said PVA latex up to weight ratio PL/PVA about 0.1. Then, 27% solution of cross-linking agent (CLA), namely glyoxal known as Aurarez 136 (Sybron Chemicals Inc.) was added to the latex mixture. The equivalent ratio of the CLA-functional groups to the stoichiometric content of free OH-groups in PVA was 1.1. Moreover, natural hydrophobizing agent, namely stearin, known as Safacid 16/18 AM (Hydro Oleochemicals A.S.) was added to the mixture.

The content of ingredients in the composition of the solid polymer-based component was as follows: PL about 8.7 wt %, CLA about 2.7 wt % and hydrophobizator about 1.1 wt %.

The composition was milled in a ball mill at 300–400 rpm during 10–15 min to obtain particles sizes of dispersion 1–2 microns.

Then the dispersion having concentration of solid about 500 g/l was applied on the Kraft-paper with density 70 g/m$^2$ by means of a bar coater. The obtained coated paper was dried at 100° C. in an air dryer during 3–5 min. The resulting composite was in the form of coated cellulose substrate. The amount of polymer-based component in the product was 20 wt %.

EXAMPLE 6

Sodium bicarbonate (Arm & Hammer Co.) was added at agitation to aqueous dispersion (latex), of polyvinyl acetate known as Servinyl 920 (Serafon Co.). The concentration of the latex was 500 g/l; Sodium bicarbonate was added to obtain pH value about 12. The latex was heated to about 35° C. and kept during 45 min. Then, citric acid (Dream Mart Co) was added to the latex at agitation up to achieve pH value about 4. Deuterium exchange analysis indicated that the obtained first polymer (PVA) contained about 9.5 wt % of free OH-groups.

Latex of the second polymer, namely polybutyl acrylate, known as Seracryl 995 (Serafon Co.) having concentration 500 g/l was introduced as plasticizer (PL) in said PVA up to weight ratio PL/PVA about 0.125. Then, 31% solution of cross-linking agent (CLA), namely glyoxal known as Aurarez 136 (Sybron Chemicals Inc.) was added to the latex mixture. The equivalent ratio of the CLA-functional groups to the stoichiometric content of free OH-groups in PVA was 0.85. Moreover, natural hydrophobizator, namely stearin, known as Safacid 16/18 AM (Hydro Oleochemicals A.S.) was introduced in the mixture.

The content of ingredients in the composition of the solid polymer-based component was as follows: PL about 9.8 wt %, CLA about 10.7 wt % and hydrophobizator about 1 wt %.

The composition was milled in a ball mill at 300–400 rpm during 10–15 min to obtain particles sizes of dispersion 1–2 microns.

Then the dispersion having concentration of solid about 500 g/l was applied on the Kraft-paper with density 55 g/m$^2$ by means of a bar coater. The coated paper was dried at 100° C. in an air dryer during 3–5 min. The resulting composite was in the form of coated cellulose substrate. The amount of polymer-based component in the product was 22 wt %.

EXAMPLE 7

Sodium bicarbonate (Arm & Hammer Co.) was added at agitation to aqueous dispersion (latex) of polyvinyl acetate known as Servinyl 920 (Serafon Co.). The concentration of the latex was 500 g/l. Sodium bicarbonate was added to obtain pH value about 11. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 4.4 wt % of free OH-groups. Latex of the second polymer, namely polybutyl acrylate, known as Seracryl 995 (Serafon Co.) having concentration 500 g/l was introduced as plasticizer in said PVA up to weight ratio PL/PVA about 0.7. Then, about 32% solution of cross-linking agent (CLA), namely melamine resin known as Resimene AQ-1616(Solutia Inc.) was added to the latex mixture. The equivalent ratio of the CLA-functional groups to the stoichiometric content of free OH-groups in PVA was 1.37. Moreover, natural hydrophobizator, namely stearin, known as Safacid 16/18 AM (Hydro Oleochemicals A.S.) was added to the mixture.

The content of ingredients in the composition of the solid polymer-based component was as follows: PL about 31.3 wt %, CLA about 22 wt % and hydrophobizator about 2 wt %.

The mixture was milled in a ball mill at 300–400 rpm during 10–15 min to obtain particles sizes of dispersion 1–2 microns.

Then the dispersion, having concentration of solid about 500 g/l, was applied on the Kraft-paper with density 70 g/m$^2$ by means of a bar coater. The coated paper was dried at 100° C. in an air dryer during 3–5 min. The resulting composite was in the form of coated cellulose substrate. The amount of polymer-based component in the product was 19 wt %.

EXAMPLE 8

Sodium bicarbonate (Arm & Hammer Co.) was added at agitation to aqueous dispersion (latex) of polyvinyl acetate known as Servinyl 920 (Serafon Co.). The concentration of the latex was 500 g/l and sodium bicarbonate was added to obtain pH value about 11. The latex was heated to about 30° C. and kept during 30 min. Then, citric acid (Dream Mart Co) was added to the latex at agitation to achieve pH value about 4. Deuterium exchange analysis indicated that the obtained first polymer—PVA contained about 4.5 wt % of free OH-groups.

Latex of the second polymer, namely polybutyl acrylate known as Seracryl 995 (Serafon Co.) having concentration 500 g/l was introduced as plasticizer (PL) in said PVA latex up to weight ratio PL/PVA about 0.037. Then, about 25% solution of cross-linking agent (CLA), namely glyoxal known as Aurarez 136 (Sybron Chemicals Inc.) was added to the latex mixture. The equivalent ratio of the CLA-functional groups to the stoichiometric content of free OH-groups in PVA was 0.33. Moreover, natural hydrophobizator, namely stearin, known as Safacid 16/18 AM (Hydro Oleochemicals A.S.) was added to the mixture.

The content of ingredients in the composition of the solid polymer-based component was as follows: PL about 3.4 wt %, CLA about 2.3 wt % and hydrophobizator about 1.5 wt %.

The mixture was milled in a ball mill at 300–400 rpm during 10–15 min to particles sizes of dispersion 1–2 microns.

Then the dispersion having concentration of solid about 500 g/l was applied on the Kraft-paper with density 70 g/m$^2$ by means of a bar coater. The coated paper was dried at 100° C. in air dryer during 3–5 min. The resulting composite was in the form of coated cellulose substrate. The amount of polymer-based component in the product was 18 wt %.

EXAMPLE 9

Sodium bicarbonate (Arm & Hammer Co.) was added at agitation to aqueous dispersion (latex) of polyvinyl acetate, known as Servinyl 920 (Serafon Co.). The concentration of the dispersion was 500 g/l; and sodium bicarbonate was added to obtain pH value about 11. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 4.3 wt % of free OH-groups.

The second polymer, namely polybutyl acrylate in latex form known as Seracryl 995 (Serafon Co.) having concentration 500 g/l was introduced as plasticizer (PL) in said PVA latex up to weight ratio PL/PVA about 0.07. Then, cross-linking agent (CLA), namely glyoxal known as Aurarez 136 (Sybron Chemicals Inc.) as about 34% solution was added to the latex mixture.

The equivalent ratio of the CLA-functional groups to the stoichiometric content of free OH-groups in PVA was 1.0.

The content of ingredients in the composition of the solid polymer-based component was as follows: PL about 6.2 wt % and CLA about 6.3 wt %.

The ingredients were mixed in a blender at 200–300 rpm during 10–15 min. Then the dispersion having concentration of solid about 500 g/l was applied on the Kraft-paper with density 70 g/m$^2$ by means of a bar coater. The coated paper was dried at 100° C. in an air dryer during 3–5 min. The resulting composite was in the form of coated cellulose substrate. The amount of polymer-based component in the product was 20 wt %.

EXAMPLE 10

Sodium bicarbonate (Arm & Hammer Co.) was added at agitation to aqueous dispersion (latex) of polyvinyl acetate known as Wallpol 40–100 (Reichhold Chemicals Inc.). The concentration of the latex was 500 g/l; Sodium bicarbonate was added to obtain pH value about 11.1. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 4.6 wt % of free OH-groups. Latex of the second polymer, namely co-polymer of ethylacrylate and ethylmethacrylate (7 wt %) known as Seracryl 40205 (Serafon Co.) having concentration 500 g/l, was introduced as plasticizer (PL) in said PVA up to weight ratio PL/PVA of about 0.07. Then, about 26% solution of cross-linking agent (CLA), namely melamine resin, known as Cymel 373 (American Cyanamid Co.), was added to the latex composition.

The equivalent ratio of the CLA-functional groups to the stoichiometric content of free OH-groups in PVA was 0.95. Moreover, to the mixture were added the following hydrophobizators, namely phenyltriethoxysilane known as Petrarch P-0320 (United Chemical Technol. Inc.) in the amount of 12 wt % and natural wax known as Carnauba wax LT-314 (Tromm GmbH) in the amount of 3 wt %.

The content of ingredients in the composition of the solid polymer-based component was as follows: PL about 4.4 wt %, CLA about 17.5 wt % and hydrophobizators about 15 wt %.

The mixture was milled in a ball mill at 300–400 rpm during 10–15 min to obtain dispersion particles sizes 1–2 microns.

Then the composition, having concentration of solid about 550 g/l was applied on the Kraft-paper with density 70 g/m$^2$ by means of a bar coater. The coated material was dried at 130° C. in an air dryer during 3–5 min. The resulting composite was in the form of coated cellulose substrate. The amount of polymer-based component in the product was 26 wt %.

EXAMPLE 11

Sodium bicarbonate (Arm & Hammer Co.) was added at agitation to aqueous dispersion (latex) of polyvinyl acetate known as Resyn 1090 (National Starch & Chemicals Co.). The concentration of the latex was 500 g/l; and sodium bicarbonate was added to obtain pH value about 11.2. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 5.0 wt % of free OH-groups.

Latex of the second polymer, namely butylacrylate-vinyl (5 wt %) co-polymer known as Everflex MA (W. R. Grace Co.) having concentration 500 g/l was introduced as plasticizer (PL) in said PVA latex up to weight ratio PL/PVA of about 0.1. Then, about 36% solution of cross-lining agent (CLA), namely succinic acid, known as A-12084 (Alfa Aesar Co.), was added to the latex mixture. The equivalent ratio of the CLA-functional groups to the stoichiometric content of free OH-groups in the PVA was 1.0. Moreover, a hydrophobizator, namely vinyltriethoxysilane known as Petrarch V-4910 (United Chemical Technol. Inc.), and a filler, namely talc known as Nytal (Gouverneur Talc Co.), were added to the mixture.

The content of ingredients in the composition of the solid polymer-based component was as follows: PL about 7 wt %, CLA about 12.2 wt %, hydrophobizator about 10 wt % and filler about 1 wt %.

The ingredients were mixed in a blender at 200–300 rpm during 10–15 min.

Then the dispersion, having concentration of solid about 600 g/l, was applied on the Kraft-paper with density 55 g/m$^2$ by means of a bar coater. The coated material was dried at 130° C. in air dryer during 3–5 min. The resulting composite was in the form of coated cellulose substrate. The amount of polymer-based component in the product was 48 wt %.

EXAMPLE 12

Sodium bicarbonate (Arm & Hammer Co.) was added at agitation to aqueous dispersion (latex) of polyvinyl acetate known as Resyn 1025 (National Starch & Chemicals Co.). The concentration of the latex was 300 g/l; Sodium bicarbonate was added to obtain pH value about 11. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 4.0 wt % of free OH-groups.

Latex of the second polymer, namely polypropyl acrylate, known as Seracryl 6825 (Serafon Co.), diluted up to concentration 280 g/l, was introduced as plasticizer (PL) in said PVA latex up to weight ratio PL/PVA about 0.14. Then, cross-linking agent (CLA), namely melamine resin, known as Resimene AQ-1616 (Solutia Inc.), as about 23% solution was added to the latex mixture. The equivalent ratio of the CLA-functional groups to the stoichiometric content of free OH-groups in PVA was 1.0.

The content of ingredients in the composition of the solid polymer-based component was as follows: PL about 10 wt % and CLA about 18 wt %.

The ingredients were mixed in a blender at 200–300 rpm for 10–15 min.

Then the composition, having concentration of solid about 300 g/l, was applied on the Kraft-paper with density 70 g/m$^2$ by means of a bar coater. The coated paper was dried at 100° C. in an air dryer during 3–5 min. The resulting composite was in the form of coated paper. The amount of polymer-based component in the product was 3 wt %.

EXAMPLE 13

Sodium bicarbonate (Arm & Hammer Co.) was added at agitation to aqueous dispersion (latex) of polyvinyl acetate known as Resyn 1025 (National Starch & Chemicals Co.). The concentration of the latex was 300 g/l; and sodium bicarbonate was added to obtain pH value about 11. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 4.0 wt % of free OH-groups.

Latex of the second polymer, namely polypropyl acrylate known as Seracryl 6825 (Serafon Co.), diluted up to concentration 280 g/l, was introduced as plasticizer (PL) in said PVA latex up to weight ratio PL/PVA about 0.125. Then, about 23% solution of cross-linking agent (CLA), namely melamine resin, known as Resimene AQ-1616 (Solutia Inc.), was added to the latex mixture. The equivalent ratio of the CLA-functional groups to the stoichiometric content of free OH-groups in PVA was 1.0. Moreover, a hydrophobizator, namely natural wax known as Carnauba wax LT-314 (Tromm GmbH) was added to the mixture.

The content of ingredients in the composition of the solid polymer-based component was as follows: PL about 9 wt %, CLA about 18 wt % and hydrophobizator about 1 wt %.

The mixture was milled in a ball mill at 300–400 rpm during 10–15 min to obtain particles sizes of dispersion 1–2 microns.

Then the porous Kraft-paper with density 30 g/m$^2$ was impregnated by the aqueous composition, having concentration of solid about 300 g/l, and then was squeezed between rubber rollers. The treated paper was dried at 130° C. in an air dryer during 3–5 min. The resulting product was in the form of bulk paper and polymer composite. The amount of polymer-based component in the product was 15 wt %.

EXAMPLE 14

Sodium bicarbonate (Arm & Hammer Co.) was added at agitation to aqueous dispersion (latex) of polyvinyl acetate known as Resyn 1025 (National Starch & Chemicals Co.). The concentration of the latex was 480 g/l; Sodium bicarbonate was added to achieve pH value of about 11.3. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 5.0 wt % of free OH-groups.

Laterx of the second polymer, namely butylacrylate-vinyl (5 wt %) co-polymer known as Everflex MA (W. R. Grace Co.) having concentration 500 g/l was introduced as plasticizer (PL) in said PVA latex up to weight ratio PLIPVA of about 0.26. Then, about 32% solution of cross-linking agent (CLA), namely succinic acid, known as A-12084 (Alfa Aesar Co.), was added to the latex mixture. The equivalent ratio of the CLA-functional groups to the stoichiometric content of free OH-groups in the PVA was 0.73. Moreover, to the mixture were added the following ingredients: a hydrophobizator, namely vinyltriethoxysilane known as Petrach V-4910 (United Chemical Technol. Inc.), as well a filler, namely talc known as Nytal (Gouverneur Talc Co.).

The content of ingredients in the composition of the solid polymer-based component was as follows: PL about 17.2 wt %, CLA about 8.6 wt %, hydrophobizator about 7 wt % and filler about 1 wt %.

The ingredients were mixed in a blender at 200–300 rpm during 10–15 min.

Then the dispersion, having concentration of solid about 550 g/l, was applied on the paperboard with density 200 g/m$^2$ by means of a bar coater. The coated material was dried at 110° C. in an air dryer during 3–5 min. The resulting composite was in the form of coated cellulose substrate. The amount of polymer-based component in the product was 9 wt %.

EXAMPLE 15

Sodium bicarbonate (Arm & Hammer Co.) was added at agitation to aqueous dispersion (latex) of polyvinyl acetate known as Wallpol 40-100 (Reichhold Chemicals Inc.). The concentration of the latex was 400 g/l; Sodium bicarbonate was added to obtain pH value about 11.5. The latex was heated to about 30° C. and kept during 35 min. Then, citric acid (Dream Mart Co) was added to the latex at agitation to achieve pH value about 4. Deuterium exchange analysis indicated that the obtained first polymer (PVA) contained about 6.1 wt % of free OH-groups. Latex of the second polymer, namely co-polymer ethylacrylate and ethylmethacrylate (7 wt %), known as Seracryl 40205 (Serafon Co.), diluted up to concentration 400 g/l, was introduced as plasticizer (PL) in said PVA latex up to weight ratio PL/PVA about 0.07. Then, about 34% solution of cross-linking agent (CLA), namely melamine resin, known as Cymel 373 (American Cyanamid Co.) was added to the latex mixture. The equivalent ratio of the CLA-functional groups to the stoichiometric content of free OH-groups in the PVA was 0.86.

Moreover, to the mixture were added the following hydrophobizators: phenyltriethoxysilane known as Petrarch P-0320 (United Chemical Technol. Inc.) in the amount of 8 wt % and natural wax known as Carnauba wax LT-314 (Tromm GmbH) in the amount of 2 wt %.

The content of the ingredients in the composition of the solid polymer-based component was as follows: PL about 4.6 wt %, CLA about 20 wt % and hydrophobizators about 10 wt %.

The mixture was milled in a ball mill at 300–400 rpm during 10–15 min to obtain particles sizes of dispersion 1–2 microns.

Then the composition, having concentration of solid about 500 g/l was applied on the cardboard with density 400 g/m$^2$ by means of a bar coater. The coated material was dried at 130° C. in an air dryer during 3–5 min. The resulting composite was in the form of coated cellulose substrate. The amount of polymer-based component in the product was 4 wt %.

EXAMPLE 16

Sodium bicarbonate (Arm & Hammer Co.) was added at agitation to aqueous dispersion (latex) of diluted polyvinyl acetate known as Wallpol 40-100 (Reichhold Chemicals Inc.). The concentration of the latex was 330 g/l; Sodium bicarbonate was added to obtain pH value of about 11.3. The latex was heated to about 30° C. and kept during 30 min. Then, citric acid (Dream Mart Co) was added to the latex at agitation to achieve pH value about 4. Deuterium exchange analysis indicated that the obtained first polymer (PVA) contained about 5.1 wt % of free OH-groups. Latex of the second polymer, namely co-polymer of ethylacrylate and ethylmethacrylate (7 wt %) known as Seracryl 40205 (Serafon Co.), diluted up to concentration 350 g/l, was introduced as plasticizer (PL) in said PVA latex up to weight ratio PL/PVA about 0.07. Then, about 26% solution of cross-linking agent (CLA), namely melamine resin, known as Cymel 373 (American Cyanamid Co.) was added to the latex mixture. The equivalent ratio of the CLA-functional groups to the stoichiometric content of free OH-groups in PVA was 0.82. Moreover, a hydrophobizator, namely natural wax known as Carnauba wax LT-314 (Tromm GmbH) was added to the composition. The content of ingredients in the composition of the solid polymer-based component was as follows: PL about 5.2 wt %, CLA about 19.2 wt % and hydrophobizator about 2 wt %.

The composition was milled in a ball mill at 300–400 rpm during 10–15 min to obtain particles sizes of dispersion 1–2 microns.

Then the dispersion, having concentration of solid about 350 g/l was applied on the cardboard with density 400 g/m$^2$ by means of a bar coater. The coated material was dried at 130° C. in an air dryer during 3–5 min. The resulting composite was in the form of coated cellulose substrate. The amount of polymer-based component in the product was 7 wt %.

EXAMPLE 17

Sodium bicarbonate (Arm & Hammer Co.) was added at agitation to aqueous dispersion (latex) of polyvinyl acetate known as Servinyl1051 (Serafon Co.). The concentration of latex dispersion was 550 g/l; Sodium bicarbonate was added to achieve pH value about 11. The latex was heated to about 30° C. and kept for 30 min. Then, citric acid (Dream Mart Co) was added to the latex at agitation to obtain pH value about 4. Deuterium exchange analysis indicated that the obtained first polymer (PVA) contained about 4.5 wt % of free OH-groups.

Latex of the second polymer, namely butylacrylate-vinyl (7 wt %) co-polymer known as Everflex SP-1084 (W. R. Grace Co.) having concentration 500 g/l was introduced as plasticizer (PL) in said PVA latex up to weight ratio PL/PVA about 0.05. Then, about 30% solution of cross-linking agent (CLA), namely glyoxal known as Protorez BLF-C (Sybron Chemicals Inc.) was introduced in latex mixture. The equivalent ratio of the CLA-functional groups to the stoichiometric content of free OH-groups in PVA was 0.80. Moreover, natural hydrophobizator, namely stearin known as Safacid 16/18 MS (Hydro Oleochemicals A.S.) was added to the mixture.

The content of ingredients in the composition of the solid polymer-based component was as follows: PL about 4.4 wt %, CLA about 5 wt % and hydrophobizator about 3 wt %.

The mixture was milled in a ball mill at 300–400 rpm during 10–15 min to obtain particles sizes of dispersion 1–2 microns.

Bleached sulfate cellulose was milled in a PFI-Beater at cellulose/water ratio 1/10 to achieve beating rate 30° SR. The ready pulp was squeezed out to bring cellulose concentration to 700 g/l. The ball milled dispersion was added to the pulp in the amount of 25 wt % to dry cellulose and the mixture of pulp with aqueous dispersion of polymer was mixed for 10–15 min at 200–300 rpm. Upon mixing the wet material was extruded through a slit spinning nozzle and then dried at 130° C. The resulting composite was in the form of flat sheet with 2 mm thickness and surface density 460 g/m$^2$.

EXAMPLE 18

Bleached sulfate cellulose was milled in a PFI-Beater at cellulose/water ratio 1/10 to achieve beating rate 60° SR. The ready pulp was squeezed out to bring the concentration of cellulose to 600 g/l. The aqueous polymer based dispersion prepared according to EXAMPLE 17 was added to the pulp. The amount of the added dispersion was 20 wt % of dry cellulose content.

The mixture was mixed for 10–15 min at 200–300 rpm. The pulp mixed with the aqueous polymer-based dispersion was extruded through a slit spinning nozzle and then dried at 130° C. The obtained cellulose composite material was in the form of flat sheets having 1.5 mm thickness.

The surface of the sheet material was coated by the above mentioned aqueous polymer dispersion applied by means of a bar coater. The coated composite material was dried at 130° C. in an air dryer during 3–5 min. The resulting coated composite material has density 540 g/m$^2$ and contains 28 wt % of polymer-based component. The non-limiting compositions of the cellulose composite materials prepared in accordance with the invention along with their properties are shown in tables 1 and 2, below.

TABLE 1

| Example: | 1 | 2 | 3 | 4 | 5 | 6 | 7 | 8 | 9 |
|---|---|---|---|---|---|---|---|---|---|
| Polymer-based component, wt. % | 18 | 14 | 10 | 31 | 20 | 22 | 19 | 18 | 20 |
| First polymer, wt. % | 90 | 80.3 | 60.2 | 72 | 87.5 | 78.5 | 44.7 | 92.8 | 87.5 |
| Second polymer, wt. % | 7.3 | 8.1 | 25.3 | 14.7 | 8.7 | 9.8 | 31.3 | 3.4 | 6.2 |

TABLE 1-continued

| Example: | 1 | 2 | 3 | 4 | 5 | 6 | 7 | 8 | 9 |
|---|---|---|---|---|---|---|---|---|---|
| Cross-linking agent, wt. % | 2.7 | 6.1 | 12 | 7.3 | 2.7 | 10.7 | 22 | 2.3 | 6.3 |
| Hydrophobizators, wt. % | 0 | 0.5 | 2 | 5 | 1.1 | 1 | 2 | 1.5 | 0 |
| Functional additives, wt. % | 0 | 5 | 0.5 | 1 | 0 | 0 | 0 | 0 | 0 |
| Water absorption, wt. % (Cobb-Test) | 13 | 11 | 12 | 5 | 18 | 21 | 5 | 17 | 14 |
| Water absorption after folding, wt. % (Cobb-Test) | 13 | 12 | 12 | 7 | 19 | 23 | 6 | 30 | 15 |
| Weight loss, % for 3 months due to biodegradation | 93 | 90 | 93 | 88 | 95 | 100 | 72 | 100 | 100 |

TABLE 2

| Example: | 10 | 11 | 12 | 13 | 14 | 15 | 16 | 17 | 18 |
|---|---|---|---|---|---|---|---|---|---|
| Polymer-based component, wt. % | 18 | 14 | 10 | 31 | 20 | 22 | 19 | 18 | 20 |
| First polymer, wt. % | 63.1 | 69.8 | 72 | 72 | 66.2 | 65.4 | 73.6 | 87.6 | 87.5 |
| Second polymer, wt. % | 4.4 | 7 | 10 | 9 | 17.2 | 4.6 | 5.2 | 4.4 | 4.4 |
| Cross-linking agent, wt. % | 17.5 | 12.2 | 18 | 18 | 8.6 | 20 | 19.2 | 5 | 5.1 |
| Hydrophobizators, wt. % | 15 | 10 | 0 | 1 | 7 | 10 | 2 | 3 | 3 |
| Functional additives, wt. % | 0 | 1 | 0 | 0 | 1 | 0 | 0 | 0 | 0 |
| Water absorption, wt. % (Cobb-Test) | 4 | 3 | 26 | 10 | 5 | 7 | 6 | 3 | 2 |
| Water absorption after folding, wt. % (Cobb-Test) | 6 | 4 | 30 | — | — | — | — | — | — |
| Weight loss, % for 3 months due to biodegradation | 70 | 55 | 95 | 93 | 90 | 88 | 92 | 84 | 80 |

These results prove that decreasing of OH-group content below 2 wt % in partly saponified PVA is associated with hindrance of cross-linking process and improves water absorption. At the same time if the content of OH-groups is above 8 wt % the resulting composite material is less waterproof (see examples 5,6 in table 1).

In accordance with the invention, the equivalent ratio of functional groups in cross-linking agent to the stoichiometric content of free OH-groups in the PVA, should be 0.4 to 1.2. It has been empirically revealed that if the above ratio is less than 0.4 the cross-linking process does not take place; and if the ratio is more than 1.2 the cross-linking degree is not increased and does not render the obtained composite material more waterproof.

In accordance with the invention it is advantageous, if the weight ratio PL/PVA lies in the range 0.05 to 0.43, and PL-content in the polymer-based component lies in the range 4 to 28 wt %. Decreasing PL/PVA ratio below 0.05 or PL-content below 4 wt % renders the obtained composite material more rigid (cracks after folding) and less waterproof (see example 8). Increasing of PL/PVA ratio above 0.43 or PL-content above 28 wt % renders the obtained composite material less biodegradable (see example 7).

Addition of environmentally friendly hydrophobizators improves waterproofing of the obtained cellulose composite material. In practice the preferred content of the hydrophobizators in the polymer-based component is 0.5 to 10 wt %. If the composition of the polymer-based component does not contain hydrophobizators the resulting cellulose composite material is insufficiently waterproof (see example 9). At the same time if the content of the hydrophobizators is more than 10 wt % the biodegradability of the resulting composite material reduces (see example 10). In accordance with the invention, the optimal amount of polymer-based component in the cellulose composite in terms of biodegradability and waterproofing is 4 to 40 wt %. If the amount of polymer-based component is less 4 wt %, then waterproofing of the resulting composite material considerable decreases (see example 12). On the other hand, if the amount of the polymer-based component is more than 40 wt % its biodegradability is inferior and it might pollute the environment (see example 11).

Cellulose composite materials of the invention are useful for production of paper, paperboard, cardboard, fabric and other composite products based on cellulose materials. It should be appreciated that the present invention is not limited by the above described embodiments and that changes and modifications can be made by one ordinarily skilled in the art without deviation from the scope of the invention as will be defined below in the appended claims.

It should also be appreciated that features disclosed in the foregoing description, and/or in the following claims, and/or examples, and/or tables may, both separately and in any combination thereof, be material for realizing the present invention in diverse forms thereof.

We claim:

1. A composite material comprising a cellulose component and a polymer-based component, wherein said polymer-based component is formed using a mixture of:

a) a first polymer comprising polyvinyl acetate latex which contains 2–8 wt. % free hydroxyl groups;

b) a second polymer comprising a non cross-linked latex selected from the group consisting of poly-($C_2$–$C_4$)-alkylacrylates, copolymers of vinyl with ($C_2$–$C_4$)-alkylacrylate and -copolymers of ($C_2$–$C_4$)-alkylacrylate with ($C_2$–$C_4$)-alkylmethacrylate, said second polymer providing improved elasticity to the first polymer upon adding the second polymer thereto; and d) a cross-linking agent.

2. A composite material as defined in claim 1, in which the weight ratio of the second polymer to the first polymer is 0.05–0.43.

3. A composite material as defined in claim 2 in which the equivalent ratio of functional groups in the cross-linking agent to the stoichiometric content of free hydroxyl groups in the first polymer is 0.4–1.2.

4. A composite material as defined in claim 1, in which said polymer-based component is formed from a mixture of:

a) 45–94 weight % of the first polymer;

b) 4–28 weight % of the second polymer; and c) 2–20 weight % of the cross-linking agent.

5. A composite material as defined in claim 1, in which said polymer-based component comprises at least one hydrophobizing agent capable to render the composite material waterproof.

6. A composite material as defined in claim 5, in which said hydrophobizing agent is at least one natural substance selected from the group consisting of natural waxes and fatty acids, and said hydrophobizing agent has a melting point 30–90 degrees C.

7. A composite material as defined in claim 5, in which said hydrophobizing agent is at least one silicon organic substance selected from the group consisting of environmentally friendly alkyl- and phenyl-alkoxysilanes, vinyl- and allylalkoxysilanes, polyalkylhydrosiloxanes and polyalkylhydroxysiloxanes.

8. A composite material as defined in claim 5, in which said polymer-based component is formed from a mixture of:

a) 45–93 weight % of the first polymer;

b) 4–28 weight % of the second polymer;

c) 2–20 weight % of the cross-linking and agent;

d) 0.5–10 weight % of the hydrophobizing agent.

9. A composite material as defined in claim 5, in which said polymer-based component comprises at least one functional additive, said functional additive is a filler or a pigment, said functional additive being an environmentally friendly substance selected from the group consisting of chalk, talc, kaolin and iron oxide.

10. A composite material as defined in claim 9, in which said polymer-based component comprises:

a) 45–93 weight % of the first polymer;

b) 4–28 weight % of the second polymer;

c) 2–20 weight % of the cross-linking agent;

d) 0.5–10 weight % of the hydrophobizing agent; and e) 0.5–5 weight % of the functional additive.

11. An article of manufacture made of a composite material comprising a cellulose containing component and a polymer-based component, wherein said polymer based component is formed from a mixture of:

a) a first polymer, said first polymer being cross-linked, said first polymer being a product of partial saponification of polyvinyl acetate latex carried out at pH 10–12, 30–35 degrees C. for 20–35 min, and said first polymer contains 2–8 wt. % of free hydroxyl groups;

b) a second polymer, said second polymer being a non cross-linked latex, said second polymer is selected from the group consisting of poly-($C_2$–$C_4$)-alkylacrylates, co-polymers of vinyl with ($C_2$–$C_4$)-alkylacrylate and co-polymers of ($C_2$–$C_4$)-alkylacrylate with ($C_2$–$C_4$)-alkylmethacrylate and said second polymer being capable to impart improved elasticity to the first polymer upon adding the second polymer thereto; and c) a cross-linking agent capable to effect cross-linking of the first polymer, said cross-linking agent contains at least two functional groups, and said functional groups being hydroxyl, carboxyl, amine or aldehyde groups.

12. An article of manufacture as defined in claim 11, in which said cellulose containing component comprises paper, paperboard, cardboard, fabric, or non-woven material.

13. An article of manufacture as defined in claim 12, in which said composite material is in the form of a bulk mixture of the cellulose containing component impregnated by an aqueous dispersion of the polymer-based component.

14. An article of manufacture as defined in claim 12, in which said composite material is in the form of a substrate consisting of the cellulose containing component, said substrate is coated by a coating applied thereto, wherein said coating consists essentially of the polymer-based component.

15. An article of manufacture as defined in claim 12, in which said composite material is in the form of a substrate consisting of a bulk mixture of the cellulose containing component impregnated an by aqueous dispersion of the polymer-based component, said substrate is coated by a coating applied thereto, and said coating consists essentially of the polymer-based component.

16. The composite material of claim 1 wherein said polymer-based component comprises up to about 48 wt. % of the composite material.

17. The composite material of claim 1 wherein said polymer based component comprises about 4 to 40 wt. % of the composite material.

18. The composite material of claim 1 wherein said cross-linking agent includes at least two functional groups taken from the group consisting of hydroxyl, carboxyl, amine and aldehyde moieties.

19. The composite material of claim 16 comprising a cellulose substrate coated with said polymer-based component to form a biodegradable, hydrophobic composite.

20. The composite material of claim 16 comprising an admixture of cellulose and polymer-based component to form a biodegradable, hydrophobic composite.

* * * * *